United States Patent [19]

Murray

[11] 3,984,958

[45] Oct. 12, 1976

[54] ROOF BATTEN ASSEMBLY

[75] Inventor: Wakefield Murray, Greensburg, Pa.

[73] Assignee: Overly Manufacturing Company, Greensburg, Pa.

[22] Filed: Dec. 2, 1975

[21] Appl. No.: 636,997

[52] U.S. Cl. ..... 52/468; 52/410; 52/359

[51] Int. Cl.[2] ..... E04B 5/57; E04D 12/00; E04D 1/36

[58] Field of Search ..... 52/461–469, 52/357–360, 410

[56] References Cited

UNITED STATES PATENTS

| | | | |
|---|---|---|---|
| 917,478 | 4/1909 | Noble | 52/359 |
| 2,907,287 | 10/1959 | Trostle | 52/467 |
| 3,055,147 | 9/1962 | Goodwin | 52/467 |
| 3,327,443 | 6/1967 | Gay et al. | 52/463 |

*Primary Examiner*—James L. Ridgill, Jr.
*Attorney, Agent, or Firm*—Parmelee, Miller, Welsh & Kratz

[57] ABSTRACT

A batten assembly for use in sealing the edges of roofing sheets includes a plurality of clips secured to the roof at spaced intervals along the slope of the roof with upward extending legs which pass through longitudinal slots in outwardly extending flanges along each side of the lower portion of a batten and are bent inward and downward over the upper edges of spaced apart longitudinal side walls of the batten to firmly secure the batten to the roof. The edges of the roofing sheets are bent upward and then inward and downward over the batten side walls and the legs of the clips and are retained in place by a cap strip which is secured to the batten by bolts threaded into sliding nuts engaged by internal flanges in the batten. A continuous longitudinal cross member in the batten, below the internal flanges, forms a water-tight channel with the side walls to carry off water which could seep into the batten over the top edges of the roofing sheets or around the cap strip bolts.

3 Claims, 4 Drawing Figures

FIG. 1.
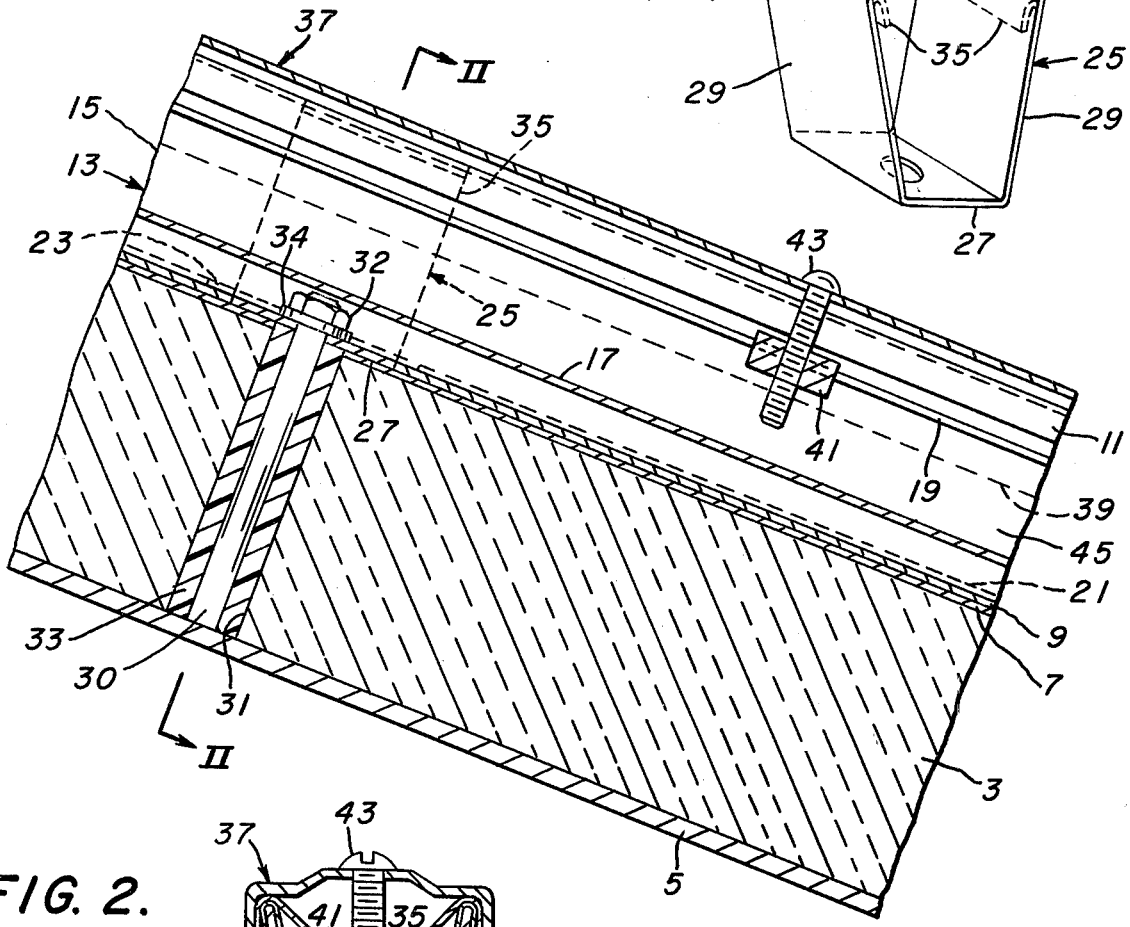
FIG. 4.
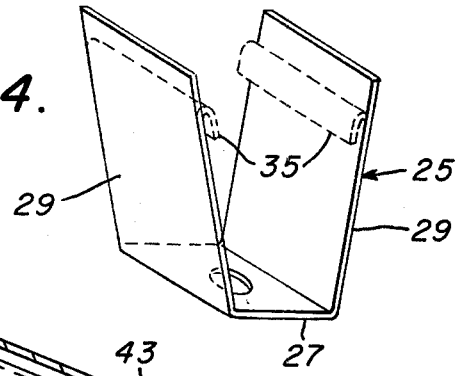
FIG. 2.
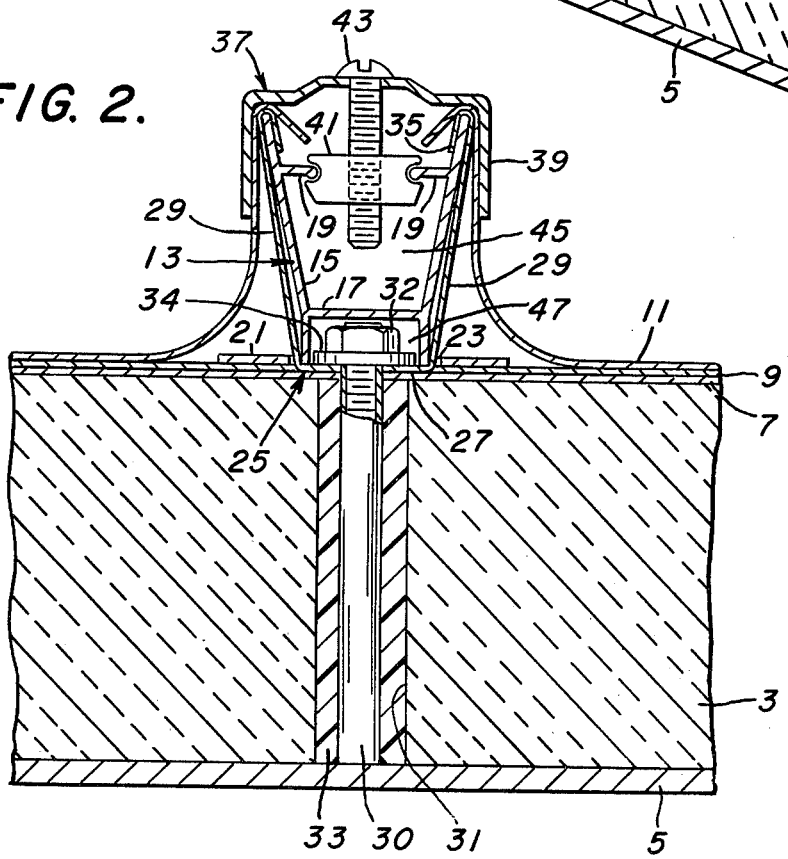
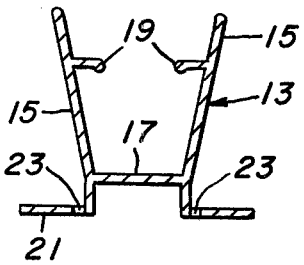
FIG. 3.

ROOF BATTEN ASSEMBLY

BACKGROUND OF THE INVENTION

1. Field of the Invention

This invention relates to roof construction and more particularly to batten-type roof construction and means for securing the same.

2. Prior Art

In a common type of roof construction, elongated members known as battens are secured to the roof parallel to the slope at spaced intervals. Roofing sheets extend between and overlap the battens and are held in place by cap strips secured to the battens. This arrangement not only provides a water-tight seal between the roofing sheets, but serves to divert and control the flow of rainwater toward the eaves. U.S. Pat. No. 2,885,974 discloses such a roof construction in which the battens are held in place along the slope of the roof by screws inserted through a base portion outside of the vertically extending flanges forming the side walls of the batten. The roofing sheets between the battens are bent upward and over the top of the batten side walls and are held in place by a cap strip secured by bolts threaded into sliding nuts engaged by opposed internal flanges on the side walls of the batten. Water which seeps over the raised edges of the roofing sheets through the bolt apertures into the cap strip is diverted to the eaves by the water-tight channel formed by the base and upwardly extending flanges.

In U.S. Pat. No. 3,055,147, a similar type of batten is held in place over insulating material by batten bearing members secured by fasteners which pass through the insulation into the roof substructure with the edges of the batten bearing members bent back over the outwardly extending flanges along the lower portion on either side of the batten.

In larger structures with slopes of extended length, it has been found that much higher battens must be provided to control and divert the large amount of water that must be shed by a roof during a heavy rainstorm. Improved means are needed for securing these larger battens in place while maintaining a water-tight seal. The improved means for securing the battens must also accommodate for the sizable changes in longitudinal dimensions brought about in the battens of extended length by variations in temperature.

SUMMARY OF THE INVENTION

According to the invention, a batten assembly for use in sealing the edges of roofing sheets includes a batten comprising a pair of upwardly and longitudinally extending side walls, a cross member securing the side walls in spaced relation, external generally outwardly extending flanges disposed along the lower portion of each side wall, a plurality of longitudinally extending and laterally aligned slots spaced at intervals along each external flange adjacent the associated side wall and cap strip securing means disposed between the side walls. The batten is firmly secured to the roof by a plurality of clips having intermediate portions secured to the roof by fasteners and leg portions at each end which extend generally upward and which pass through the longitudinal slots in the external batten flanges and are bent inward and downward over the top edges of the side walls. A cap strip with depending side walls which fit down over the batten side walls, secures the edges of roofing sheets which are bent upward along the batten side walls and then inward and downward over the top edge of the side walls and the clip legs. Fasteners secure the cap strip to the cap strip securing means between the batten side walls.

Preferably, the longitudinal cross member is continuous between the batten side walls intermediate their vertical height to form therewith an upwardly facing water-tight channel for diverting water which seeps over the bent edges of the roofing sheets or around the cap strip fasteners, and a downwardly facing channel which straddles the clip fasteners. Also, preferably, the cap strip securing means includes opposed spaced internal flanges extending inwardly from the batten side walls above the cross member and attachment members which engage the cap strip fasteners and have slots on either side which slidably engage the internal flanges on the batten.

BRIEF DESCRIPTION OF THE DRAWINGS

FIG. 1 is a partial longitudinal vertical section through the batten portion of a roof construction in accordance with the invention;

FIG. 2 is a section through the batten portion of the roof construction shown in FIG. 1 taken along line II—II;

FIG. 3 is a vertical transverse section of the batten alone; and

FIG. 4 is a perspective view of a clip according to the invention.

DESCRIPTION OF THE PREFERRED EMBODIMENT

In the drawings, 3 designates roof planking, which can be wood, metal, insulating material, etc., supported by the purlins 5, such as metal I-beams the top flange of which is shown, extending transverse to the slope of the roof. On top of the planking is a layer of roofing felt 7 covered by a layer of roofing paper 9. Finally, the roof is covered by roofing sheets 11 which can be, for instance, 16 gauge aluminum sheets. As will be appreciated as the description progresses, the particular construction of the roof below the roofing sheets is not critical and the construction disclosed is meant to be illustrative only.

Along the seams between adjoining roofing sheets 11 are battens 13 (only one shown) disposed parallel to the slope of the roof. Each batten 13 has longitudinally extending side walls 15 secured in spaced relation by a continuous longitudinally extending cross member 17. As shown, the side walls diverge above the cross member 17. Opposed spaced internal flanges 19, having beaded longitudinal edges, extend inwardly from the diverging side walls. Projecting horizontally outward from the lower end of each side wall 15 is an external longitudinal flange 21. Laterally aligned longitudinal slots 23 are provided at spaced intervals in the external flanges for securing the batten to the roof. These battens may be extruded from aluminum or any other suitable material.

The battens are secured in place along the slope of the roof by clips 25. Each clip has an intermediate portion 27 and a pair of legs 29 extending generally upward from either end of the intermediate portion. The clips 25 are secured to the roof at spaced intervals corresponding to the spacing between the longitudinal slots 23 in the batten, such as by studs 30 which may be set in bores 31 in the roof planking 3 and welded to the purlins 5. Once the studs are set, the bores 31 are filled with a suitable cement 33. Nuts 32 threaded onto the studs 30 over washers 34 firmly anchor the clips.

The legs 29 of the clips pass through the longitudinal slots 23 in the external flanges on the battens and extend upward along the side walls 15. The top portion 35 of each leg is bent inward and downward over the top edge of the side wall to firmly secure the batten in place. The edges of the roofing sheets 11 adjacent the batten are bent upward along the side walls and then inward and downward over the outer portions 35 of the clips.

A cap strip 37, in the form of an inverted channel with depending side walls 39, fits down over upward extending side walls 15 of the batten and the inwardly bent edges of the clips and the roofing sheet. Cap strip attachment members in the form of slotted sliding nuts 41 engage the edges of the opposed internal flanges 19 at spaced intervals to form cap strip securing means. Fasteners, such as bolts 43, threaded into the sliding nuts 41 secure the cap strip to the batten.

The disclosed arrangement provides a leak-proof seal between adjoining roofing sheets and helps to control and divert the flow of water on the roof. Water which might seep into the batten by passing up along the up-turned edges of the roofing sheets 11 or through the apertures in the cap strip for the bolts 43, drops into the upward facing water-tight channel 45 formed by the side walls 15 and the continuous cross member 17 and is thus carried to the eaves where it is discharged. The side walls 15 and cross member 17 also form a downwardly facing channel 47 which straddles the studs 29 securing the clips 25 to the roof. Since the studs 29 are thus below the water-tight channel 45, no water can leak around the studs into the roof. At the same time, the battens are firmly secured by the clips against the forces developed by the torrents of rainwater which are diverted and controlled by the batten. Although the batten is held firmly by the clips, the slots 23 allow for thermal expansion and contraction of the extended length battens which can be appreciable under some conditions.

I claim as my invention:

1. A batten assembly for use in sealing the edges of roofing sheets including: a batten comprising a pair of upwardly and longitudinally extending side walls, a longitudinally extending cross member securing the two side walls in spaced relation, external generally outwardly extending flanges disposed along the lower portion of each side wall, a plurality of longitudinally extending and laterally aligned slots spaced at intervals along each external flange adjacent the associated side wall, and cap strip securing means disposed between said side walls; a plurality of clips having intermediate portions securing the same to the roof by fasteners at spaced intervals along the confronting edges of adjacent roofing sheets, each said clip having leg portions which extend generally upward from each end of the intermediate portion and which pass through the longitudinal slots in the external flanges on each side of the batten and are bent inward and downward over the top edge of the adjacent side wall to firmly secure the batten in place; a cap strip with depending side walls which fit down over the edges of the roofing sheets adjacent the batten which are bent upward along the batten side walls and then inward and downward over the top edge of the batten side walls and the clip legs; and fasteners securing the cap strip to the cap strip securing means between the batten side walls.

2. The batten assembly of claim 1 wherein said longitudinally extending cross member is continuous between the side walls of the batten intermediate their vertical height and forms therewith an upwardly facing water-tight channel which diverts water that seeps up and over the bent edges of the roofing sheets and around the cap strip fasteners, and a downwardly facing channel which straddles the clip fasteners.

3. The batten assembly of claim 1 wherein the cap strip securing means comprises opposed spaced internal flanges extending inwardly from the batten side walls above the cross members, and cap strip attachment members engaging the cap strip fasteners and having slots in either side thereof which slidably engage the opposed internal flanges on the batten sidewalls.

* * * * *